US012492620B2

(12) United States Patent
Ding et al.

(10) Patent No.: US 12,492,620 B2
(45) Date of Patent: Dec. 9, 2025

(54) HYDRAULICALLY ACTUATED DOUBLE-ACTING POSITIVE DISPLACEMENT PUMP SYSTEM FOR PRODUCING FLUIDS FROM A WELLBORE

(71) Applicant: PMC Pumps Inc., Calgary (CA)

(72) Inventors: Yuchang Ding, Calgary (CA); John Hughes, Calgary (CA); Gary Cheng, Calgary (CA)

(73) Assignee: PMC Pumps Inc., Calgary (CA)

( * ) Notice: Subject to any disclaimer, the term of this patent is extended or adjusted under 35 U.S.C. 154(b) by 0 days.

(21) Appl. No.: 18/250,113

(22) PCT Filed: Oct. 22, 2021

(86) PCT No.: PCT/CA2021/051494
§ 371 (c)(1),
(2) Date: Apr. 21, 2023

(87) PCT Pub. No.: WO2022/082319
PCT Pub. Date: Apr. 28, 2022

(65) Prior Publication Data

US 2024/0052732 A1 Feb. 15, 2024

(30) Foreign Application Priority Data

Oct. 23, 2020 (CA) ..... CA 3098027

(51) Int. Cl.
*E21B 43/12* (2006.01)
*E21B 17/00* (2006.01)
*F04B 47/08* (2006.01)

(52) U.S. Cl.
CPC ..... *E21B 43/129* (2013.01); *E21B 17/003* (2013.01); *F04B 47/08* (2013.01)

(58) Field of Classification Search
CPC ..... E21B 43/129; F04B 47/04; F04B 47/08
See application file for complete search history.

(56) References Cited

U.S. PATENT DOCUMENTS 2,051,243 A * 8/1936 Bowling ..... F04B 47/08 417/526
4,541,783 A * 9/1985 Walling ..... F04B 47/06 92/108

(Continued)

FOREIGN PATENT DOCUMENTS

CA 2988315 6/2018
CA 3120342 A1 9/2020

OTHER PUBLICATIONS

International Search Report and Written Opinion issued in application No. PCT/CA2021/051494, mailed Jan. 25, 2022.

(Continued)

*Primary Examiner* — Kenneth J Hansen
(74) *Attorney, Agent, or Firm* — Knobbe, Martens, Olson & Bear, LLP

(57) ABSTRACT

A submersible downhole pumping system is provided. The pumping system is designed so that all fluid conduits and electrical signal conduits are internalized within a pumping assembly. This design provides a substantially constant and slim profile to the pumping assembly. The pumping assembly comprises a housing that houses a power assembly, a powered actuator assembly that is operatively linked to a production fluid assembly and a central bore that extends through the pumping assembly to provide fluid communication between the power assembly and a first end of the pumping assembly. The pumping system further includes a flow distributor/connector at the first end or pump head for providing fluids' communication between the pump head and a conducting system that extends from surface to the pumping system. The communication fluids include high pressure power hydraulic fluid, low pressure exhaust hydraulic fluid and pressurized produced wellbore fluid.

10 Claims, 14 Drawing Sheets

(56) References Cited

U.S. PATENT DOCUMENTS

| | | | | |
|---|---|---|---|---|
| 8,997,852 | B1 | 4/2015 | Lee et al. | |
| 9,617,838 | B2 | 4/2017 | Purcell et al. | |
| 2009/0194294 | A1 | 8/2009 | Williams | |
| 2011/0061873 | A1 | 3/2011 | Patterson et al. | |
| 2017/0260851 | A1 | 9/2017 | Rendusara | |
| 2018/0156015 | A1* | 6/2018 | Ding | F04B 9/113 |

OTHER PUBLICATIONS

Supplementary European Search Report for EP 21881425 dated Jul. 15, 2024.
Office Action issued in SA 523440483 dated Aug. 19, 2025.

* cited by examiner

600

FIG. 2A
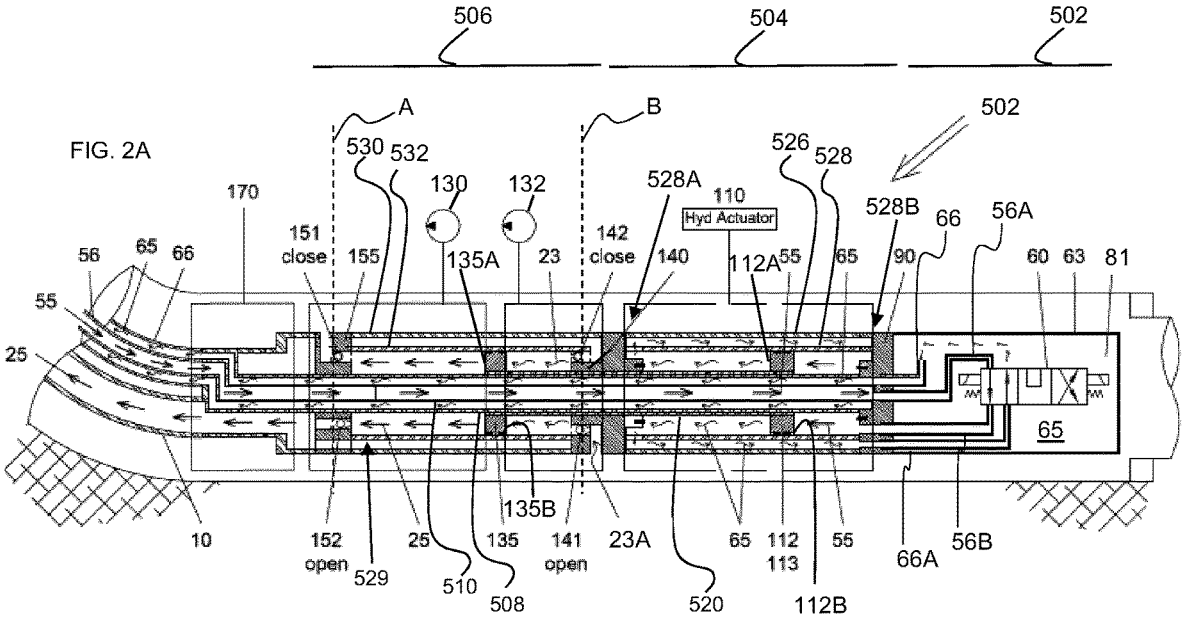
FIG. 2B
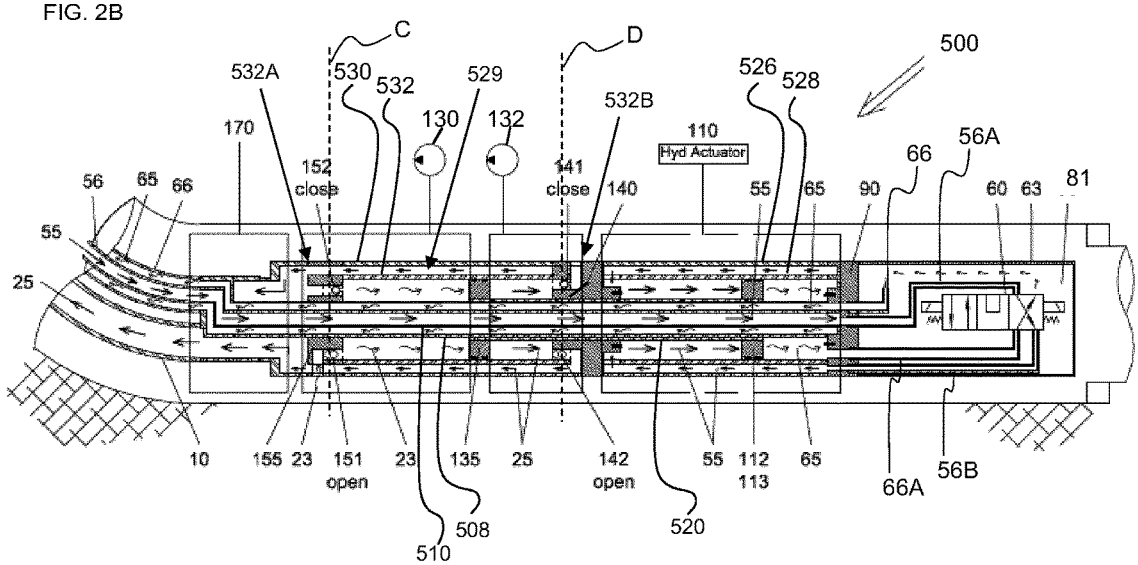
FIG. 2

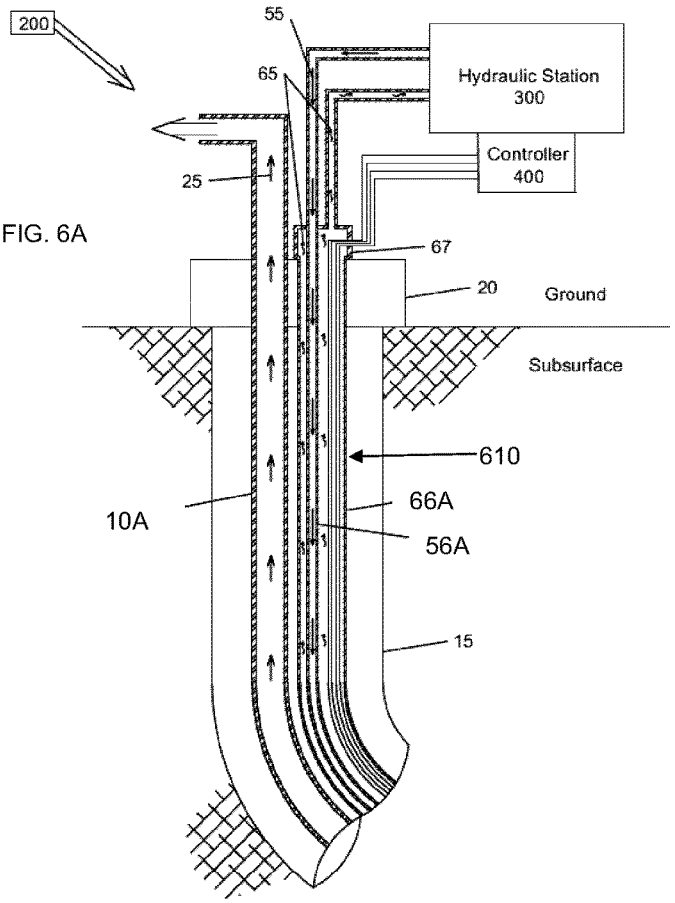
FIG. 6A
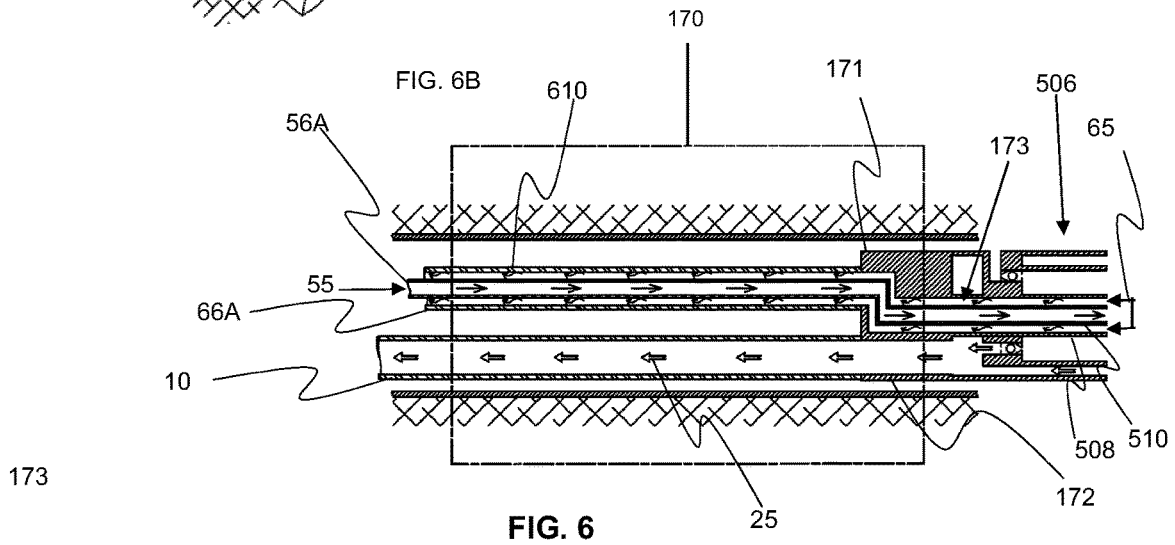
FIG. 6B
FIG. 6

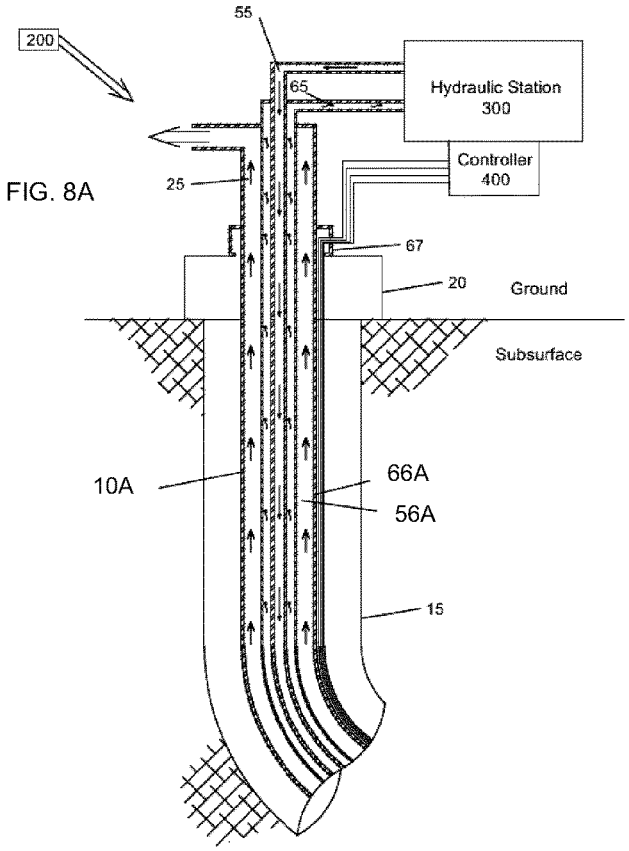
FIG. 8A
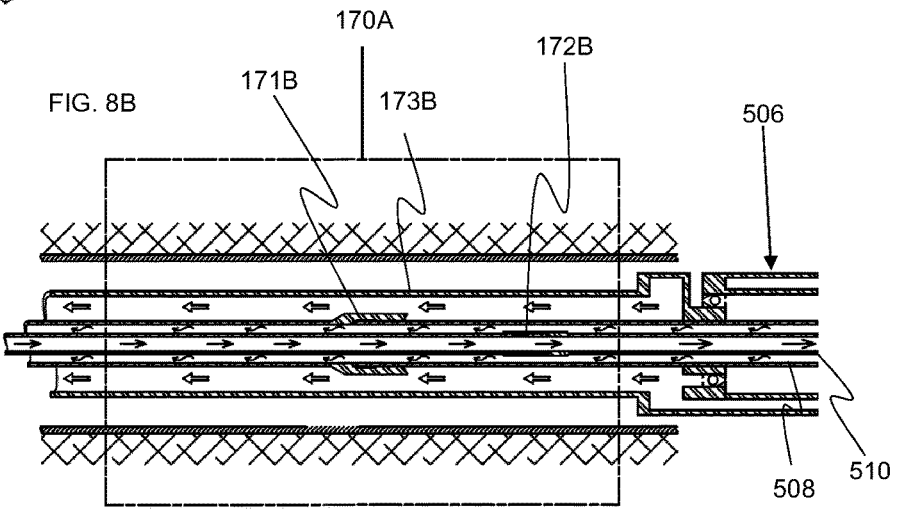
FIG. 8B
FIG. 8

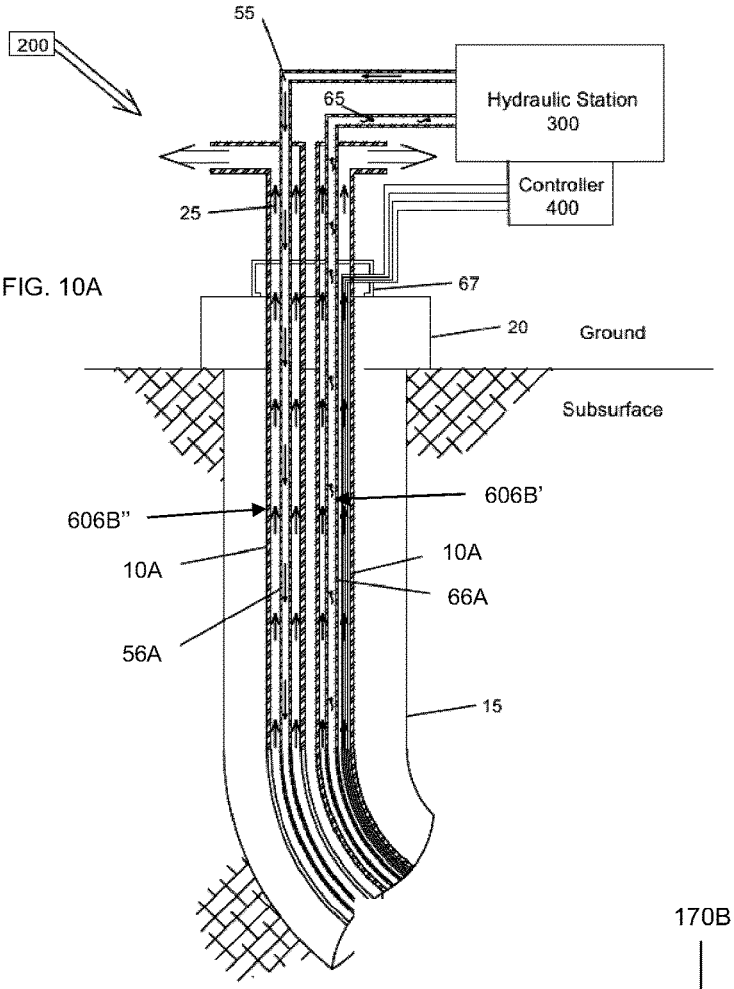
FIG. 10A
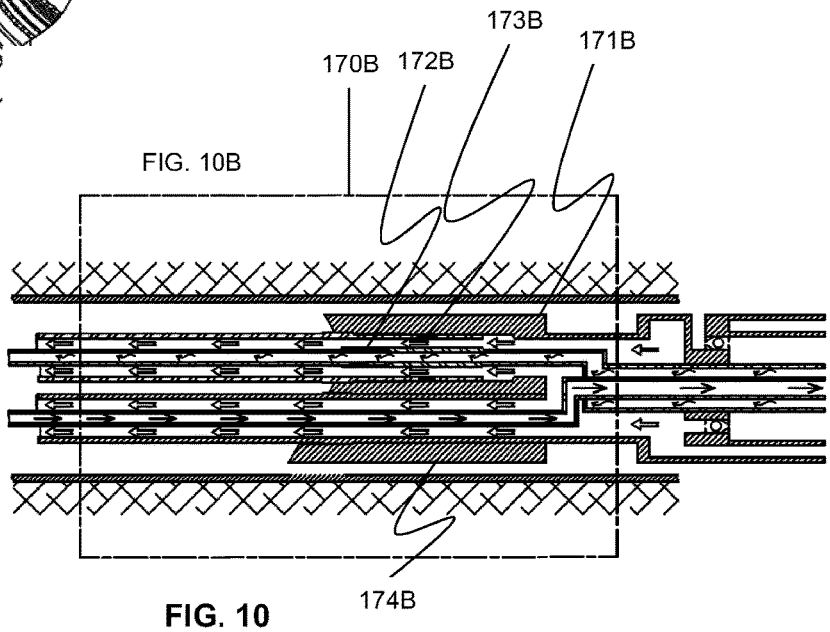
FIG. 10B
FIG. 10

FIG. 14A
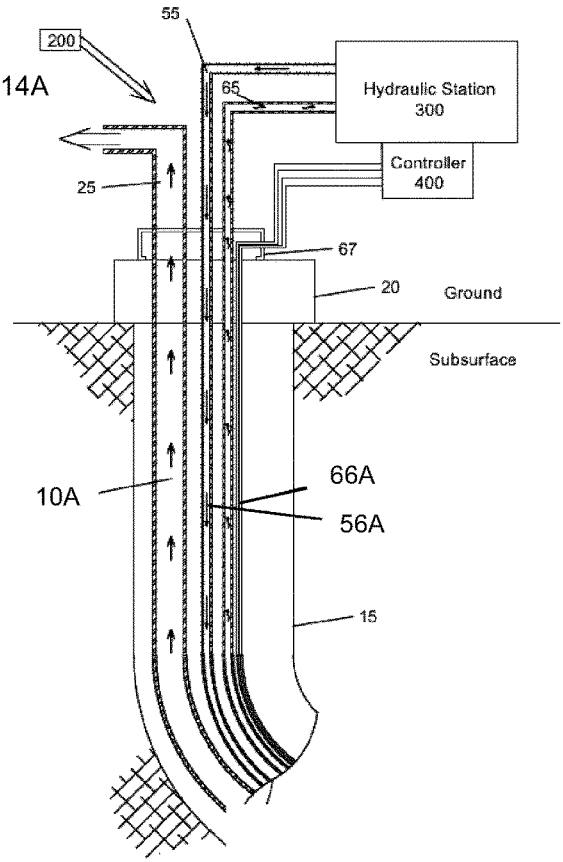
FIG. 14B
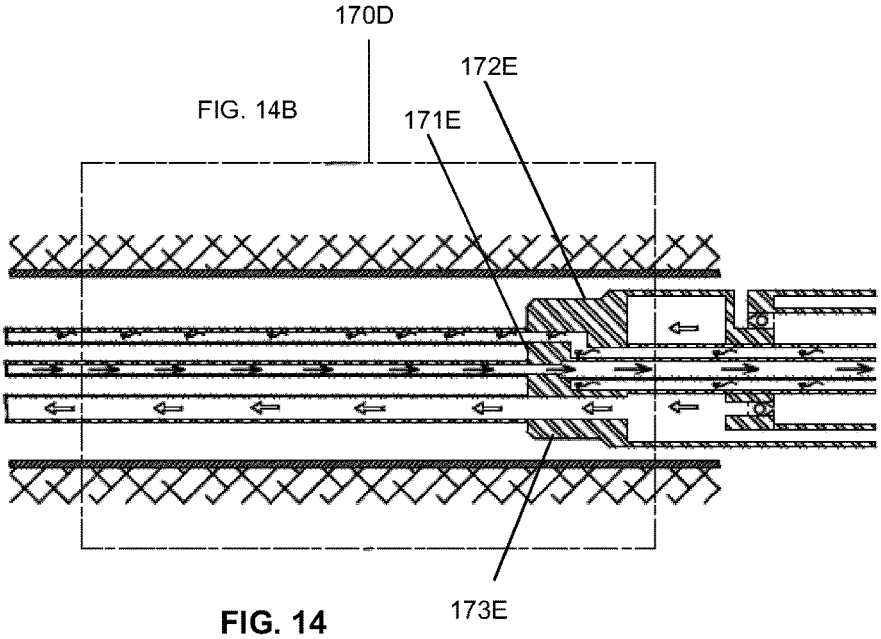
FIG. 14

HYDRAULICALLY ACTUATED DOUBLE-ACTING POSITIVE DISPLACEMENT PUMP SYSTEM FOR PRODUCING FLUIDS FROM A WELLBORE

TECHNICAL FIELD

The present disclosure is direct at apparatus and systems for delivering fluids from the surface to a downhole pump within a wellbore and for delivering fluids from the pump back to the surface. In particular, the embodiments of the present disclosure comprise a slim profile pumping system that is sized for use in wellbores of various dimensions.

BACKGROUND

It is known to use reciprocating linear pumps installed in line at the bottom end of a wellbore, attaching conduit between the pump and surface collection equipment, and powering the reciprocal motion of the pump, typically of pistons deployed within a cylinder with associated flow valve controls such as one-way valves to control fluid flow within the pump subassembly, by a series of sucker rods connected end-to-end and attached at the lowest end to the pump subassembly, and at the highest end to some mechanism such as pump-jack or similar drive mechanism providing reciprocating linear motion under power from surface to the pump subassembly. The linear pumps may be a series or stages of lift pistons and packers with suitable one-way valves at each stage. These systems are time-worn, time-tested, and provide high reliability, but cannot be practically deployed in deviated wellbores (commonly referred to as 'horizontal wells'), due to the inability of a series of rigid interconnected rods to move linearly around the corner or bend in a deviated wellbore without impacting the well's inner wall, causing damage and wear to both casing and the rod system. Additionally, pump-jack style lift systems provide a very uneven pressure profile and relatively low and uneven flow rate of produced fluid, resulting in lower pumping volumes and inefficiencies. These pumps are very common and form part of the common general knowledge within the field of the invention.

A known solution for delivering produced fluids from horizontal wells is using relatively flexible fluid conduits that are fluidly connected to an electrical submersible pump (ESP). Known ESPs may have a variety of externally connected fluid conduits and electrical conductors in order to deliver fluids and electrical command signals to where they must be delivered for proper function.

SUMMARY

Without being bound by any particular theory, the embodiments of the present disclosure relate to a pumping assembly that has all related fluid conduits fluidly communicate to the associated sub-assemblies inline with a longitudinal axis of the assembly. The fluid conduits are positioned internal to an outer surface of the pumping assembly. Furthermore, the embodiments of the present disclosure provide internalized electrical conductors that enter one end of the pumping assembly and extend substantially along the longitudinal axis of the pumping assembly in order to deliver (and receive) electrical signals to a power assembly at the downhole end of the pumping assembly. The inline and internal fluid conduits and the internal electrical conductors allow the outer surface of the pumping assembly to have a substantially constant outer diameter along its length and to have a substantially smooth external profile. Without being bound by any particular theory, the substantially constant outer diameter and the smooth external profile may allow the pumping assembly to have a smaller cross-sectional area so that it can be used in smaller wellbores that known pumps may not fit into.

Some embodiments of the present disclosure relate to a downhole pumping assembly. The pumping assembly including a first end and a second end defining an outer surface therebetween, the outer surface having a substantially constant outer diameter. The pumping assembly further including a power assembly proximal the second end and configured to direct a power fluid and a production fluid assembly proximal the first end and configured to receive wellbore fluids and comprising a production piston configured to direct the received wellbore fluids towards the first end. The pumping assembly also including a powered actuation assembly positioned adjacent the power assembly and in fluid communication therewith, the power actuation assembly is operatively coupled to the production fluid assembly, the powered actuation assembly configured to receive the power fluid and to move the production piston via the operative coupling for directing the received wellbore fluids towards the first end; and a central conduit that extends from the first end to the power assembly for conducting the power fluid therebetween.

Some embodiments of the present disclosure relate to a connector, also referred to herein as a flow distributor. The connector having a first end that is connectible to a fluid conducting system and a second end that is connectible to a pumping assembly. The connector also includes an inner fluid channel that is in fluid communication with a first fluid conduit, a second fluid conduit and a third fluid conduit. The inner fluid channel conducts the fluid contents of the first fluid conduit to exit the second end in a substantially centralized position, relative to the body of the connector. The connector is also configured to provide one or more internal conductor channels to allow one or more electrical conductors to extend therethrough.

Some embodiments of the present disclosure relate to a system that comprises a subsurface fluid conducting system for directing a power fluid to a connector and for directing an exhaust fluid from the connector to a surface. The system further comprises the connector for directing the power fluid, the exhaust fluid and a production fluid therethrough. The system further comprises a pumping assembly that is fluidly connectible at a first end to the connector. The pumping assembly includes a power assembly at an opposite end to the first end and a powered actuator assembly. The powered actuator assembly is in fluid communication with the power assembly for moving a powered piston of the powered actuator assembly. The Pumping assembly also includes a production fluid piston that is operatively linked to the powered piston. The pumping assembly further including a central conduit that extends from the first end to the power assembly, the central bore is configured to receive a power fluid from the fluid conducting system for conducting same to the power assembly.

In some embodiments of the present disclosure, the fluid conducting system is configured to house one or more electrical conductors that are extendible from the surface to the connector. In some embodiments of the system, the fluid conducting system comprises a conduit for conducting production fluids received from the connector to a wellhead above. The fluid conducting system also comprises a set of two conduits, one positioned within the other, the set of two conduits is configured to be fluidly connectible with the central conduit of the pumping assembly. The set of two conduits are further configured for delivering a power fluid to the central conduit and for receiving an exhaust fluid from the central conduit. In these embodiments, the connector defines an inner fluid flow channel system that is configured to direct the appropriate fluid from the pumping assembly to the appropriate fluid conduit of the fluid conducting system.

In some embodiments of the present disclosure, the fluid conducting system comprises three fluid conduits, with a first conduit positioned in a second conduit and the second conduit positioned within a third conduit. One of the three conduits is configured for delivering a power fluid from surface to the connector. Another of the three conduits is configured for delivering an exhaust fluid from the connector to the surface above. Another of the three conduits is configured for delivering a production fluid from the connector to the surface above. In these embodiments, the connector defines an inner fluid flow channel system that is configured to direct the appropriate fluid from the pumping assembly to the appropriate fluid conduit of the fluid conducting system.

In some embodiments of the present disclosure, the fluid conducting system comprises two sets of fluid conduits, with each set having a first conduit positioned in a second conduit. The outer conduit of each set may deliver a production fluid from the connector to the surface. The inner conduit of one set may deliver a power fluid from the surface to the connector and the inner conduit of the other set may deliver an exhaust fluid from the connector to the surface. In these embodiments, the connector defines an inner fluid flow channel system that is configured to direct the appropriate fluid from the pumping assembly to the appropriate fluid conduit of the fluid conducting system.

In some embodiments of the present disclosure, the fluid conducting system comprises two fluid conduits, one positioned inside the other. The inner fluid conduit is configured to deliver a power fluid from the surface to the connector and the outer conduit is configured to deliver an exhaust fluid from the connector to the surface. In these embodiments, the connector defines an inner fluid flow channel system that is configured to direct the appropriate fluid from the pumping assembly to the appropriate fluid conduit of the fluid conducting system. In these embodiments, the connector is configured to sealing engage the inner surface of a wellbore so that a production fluid can be conducted to the surface by the wellbore.

In some embodiments of the present disclosure, the fluid conducting system comprises three separate fluid conduits, one for conducting a power fluid to the connector, one for conducting an exhaust fluid from the connector to surface and the other for conducting a production fluid from the connector to the surface.

BRIEF DESCRIPTION OF THE DRAWINGS

The features of the present disclosure will become more apparent in the following detailed description in which reference is made to the appended drawings.

FIG. 2 is a schematic depicting operation of a pumping assembly of the system in FIG. 1, wherein FIG. 2A shows a piston moving in a first direction; and, FIG. 2B shows the same piston moving in the opposite direction at a different rotational view than FIG. 2A.

FIG. 3 is a schematic depicting a valve assembly, wherein FIG. 3A shows the operational position of the valve assembly according to the operation depicted in FIG. 2A; and, FIG. 3B shows the operational position of the valve assembly according to the operation depicted in FIG. 2B.

FIG. 6 shows components of the system depicted in FIG. 4 in greater detail, wherein FIG. 6A shows a fluid conducting system and surface equipment; and, FIG. 6B shows a connector.

FIG. 8 shows components of the system depicted in FIG. 7 in greater detail, wherein FIG. 8A shows a fluid conducting system and surface equipment; and, FIG. 8B shows a connector.

FIG. 10 shows components of the system depicted in FIG. 9 in greater detail, wherein FIG. 10A shows a fluid conducting system and surface equipment; and, FIG. 10B shows a connector.

FIG. 12 shows components of the system depicted in FIG. 11 in greater detail, wherein FIG. 12A shows a fluid conducting system and surface equipment; and, FIG. 12B shows a connector.

FIG. 14 shows components of the system depicted in FIG. 13 in greater detail, wherein FIG. 14A shows a fluid conducting system and surface equipment; and, FIG. 14B shows a connector.

DETAILED DESCRIPTION

Unless defined otherwise, all technical and scientific terms used herein have the meanings that would be commonly understood by one of skill in the art, in the context of the present disclosure. Although any methods and materials similar or equivalent to those described herein can also be used in the practice or testing of the present disclosure, the preferred methods and materials are now described. Any publications mentioned herein are incorporated herein by reference in their entirety.

The embodiments of the present disclosure relate to downhole and, therefore, submersible pumping systems for delivering produced fluids within a wellbore from a subsurface region to above-ground equipment. The embodiments of the present disclosure relate to a pumping system with a pumping assembly that includes an outer housing and that is designed to house all functional components and conducting components of the pumping assembly. Without being bound by any particular theory, the housing of the functional components and conducting components of the pumping assembly allow the outer surface of the outer housing to have a smaller outer diameter than other downhole pumping assemblies. The housing of the functional components and conducting components of the pumping assembly may also permit the outer housing to have a substantially constant outer profile. The small outer diameter and/or the substantially constant outer profile may allow the pumping system to be used in wellbores that have inner diameters of about 5.5 inches (one inch is about 2.54 cm) or greater.

Figure 1:
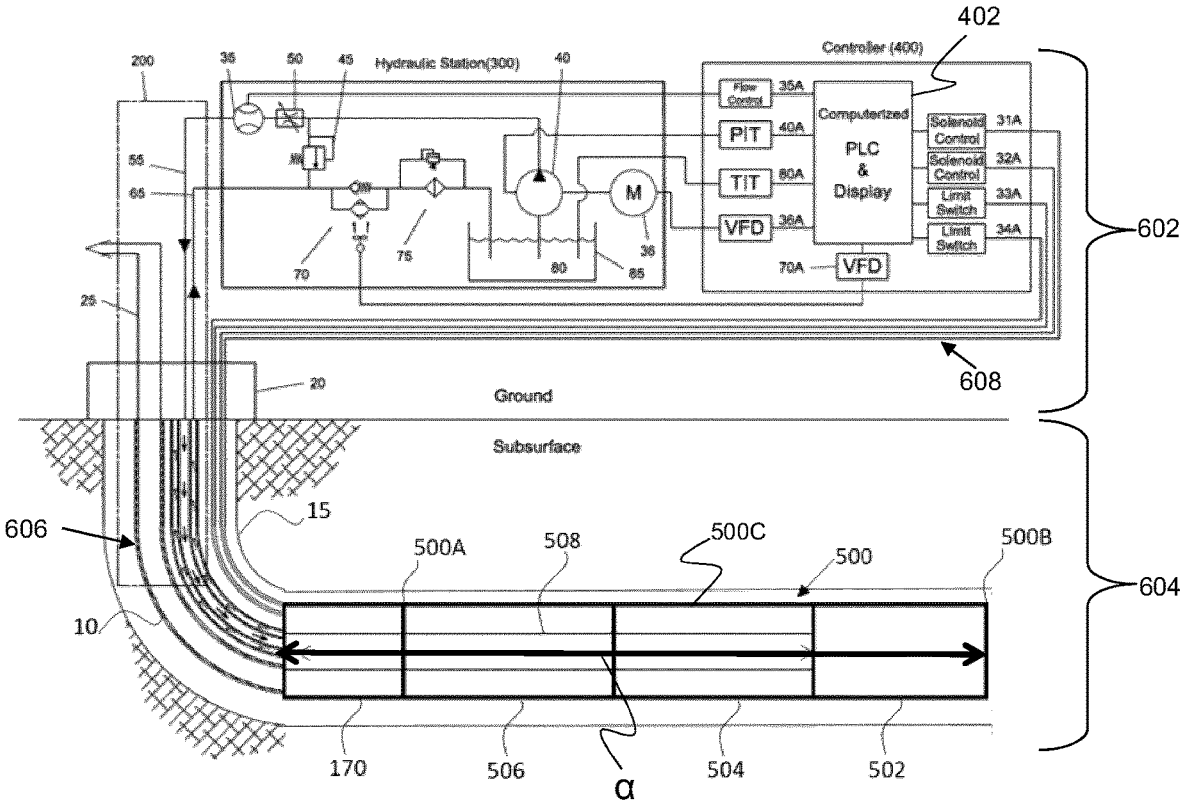
FIG. 1 is a schematic depicting a system, according to embodiments of the present disclosure, configured for delivering fluids from surface into a well and to a down hole pump and for delivering fluids from the pump back to the surface.

FIG. 1 is a non-limiting schematic of a pumping system 600 according to the embodiments of the present disclosure. The system 600 includes an above-ground system 602 of equipment and a subsurface system 604 of equipment. The above-ground system 602 comprises a hydraulic station 300 and a controller system 400. The hydraulic station 300 includes a hydraulic tank 85 for housing volume of hydraulic fluid 80. A primary hydraulic displacement pump 40 is in fluid communication with the tank 85 for drawing and pressurizing the hydraulic fluid 80 into a power fluid 55, which may flow through a first flow control meter 50 and/or a second flow control meter 35 before entering a power conduit 56. The power conduit 56 contains the pressurized power fluid 55 that is capable of powering one or more components of the subsurface system 604. The hydraulic station 300 may receive a return conduit 66 that contains a low pressure, exhaust fluid 65 that has returned from the subsurface system 604. The return conduit 66 is in fluid communication with the tank 85 and the exhaust fluid may pass through a hydraulic fluid cooling apparatus 70 and/or a filter 75 before entering the tank 85.

The controller system 400 may be operatively connected to one or more components of the hydraulic station 300. For example, the controller 400 may comprise a computerized programmable logic controller (PLC) 402. The PLC 402 may include a display and a flow meter module 35A for flow control of the power fluid 55 by controlling flow control meter 35. The PLC 402 may also include a pressure control system (P/T) 40A that is configured to control the pressure of power fluid 55 via controlling activity of the primary hydraulic displacement pump 40. The PLC 402 may also include a temperature control system (T/T) 80A for controlling the temperature of the fluid 80 within the tank 85 via one or more temperature sensors and heating elements (not shown). The PLC 402 may further include a variable frequency drive (VFD) 36A that controls the activity of the primary hydraulic displacement pump 40 and a further VFD 70A that controls the cooling apparatus 70.

The PLC 402 may also include one or more solenoid controllers 31A and 32B and one or more limit switch controllers 33A and 34A. Commands, in the form of electrical signals, from the controllers 31A, 32A, 33A and 34A can be transmitted to the subsurface equipment via an electrical conducting system 608. As will be appreciated by those skilled in the art, the electrical conducting system 608 may be protected from the harsh environment present within the wellbore so as to provide efficient communication of commands from the controllers 31A, 32A, 33A and 34A to the subsurface equipment.

The PLC 402 may be configured to coordinate the delivery of power fluid 55 via conduit 56—at a desired pressure and temperature—and the movement of one or more components of the subsurface equipment 604 via the controllers 31A, 32B, 33A and 34A. As will be appreciated by those skilled in the art, the PLC 402 may be pre-programmed to perform this coordination and/or it may respond to commands entered by a user.

The above-ground system 602 may further include a wellhead system 200 that includes a wellhead 20 that is configured to receive the conduits 55 and 65, the conductors of the electrical conducting system 608 and a production fluid outlet 25. The wellhead system 200 is further configured, among other functions, to provide pressure control of fluids within a wellbore 15 of the subsurface system 604. The wellbore 15 may be lined, cased, cemented or not and the wellbore 15 is configured to receive produced fluids, for example as a multiphase flow of solids, gas and liquids, from a subsurface reservoir proximal thereto. The reservoir may be stimulated by hydraulic fracturing, thermal stimulation (such as cyclic steam cycling, steam assisted gravity drainage, heated solvent stimulation), chemically stimulated (such as solvent stimulation) and the like.

The subsurface system 604 may include a pump assembly 500 and a fluid conducing system 606 that extends from the pump assembly 500 to the wellhead 20. The fluid conducting system 606 provides one or more conduits conducting the power fluid 55 from conduit 56 to the pump assembly 500 and the exhaust fluid 65 from the pump assembly 500 to the conduit 66. In some embodiments of the present disclosure, the fluid conducting system 606 may also provide an optional production conduit 10 for conducting production fluids to the production fluid outlet 25. In some embodiments of the present disclosure, the fluid conducting system 606 may also provide a conduit for the electrical conducting system 608 to extend from the wellhead to the pumping assembly 500.

The pumping assembly 500 is configured to be positioned within an oil and/or gas well and to receive production fluids. The pumping assembly 500 is configured to pressurize and deliver the received production fluids (shown as unpressurized received production fluids 23 and pressurized received production fluid in FIG. 2) to the production fluid outlet 25 of the wellhead system 200. The pumping assembly 500 has a first end 500A and a second end 500B for defining a longitudinal axis (represented by line a in FIG. 1) of the pumping assembly 500. As will be appreciated by those skilled in the art, the first end 500A is closer to the wellhead 20 and, therefore, it may also be referred to as an uphole end. The second end 500B is further from the wellhead 20 and, therefore, it may also be referred to as the downhole end. The term "uphole" may be used herein to refer to an end of a component or a directional orientation within the well that is towards the wellhead 20. The term "downhole" may be used herein to refer to a component or a directional orientation within the well that is away from the wellhead 20.

In some embodiments of the present disclosure, the pumping assembly 500 comprises three primary components: a power assembly 502, a powered actuator assembly 504 and a production fluid assembly 506. The pumping assembly 500 further includes a central conduit 508 that extends from the first end 500A through the production fluid assembly 506 and the powered actuator assembly 504 to the power assembly 502. The central conduit 508 may be centrally located within the cross-sectional area of the pumping assembly 500, or in some embodiments it may be positioned non-centrally. The central conduit 508 is configured to provide fluid communication between the downhole end of the fluid conducting system 606, via a connector 170 (which is also referred to as a flow distributor), and the power assembly 502.

The power assembly 502 is configured to receive the power fluid 55 from the conduit 56, via the central conduit 508. The power assembly is further configured to direct the power fluid 55 to the powered actuator assembly 504 for moving a powered piston 112 therein. The powered piston 112 is operatively coupled by a linking member 520 (see FIG. 2) to a production piston 135 so that if the powered piston 112 moves in a first direction, the production piston 135 will move in the same direction and the same stroke distance. If the powered piston 112 moves in a second, opposite direction, the production piston 135 will also move in the second direction and distance the same stroke distance as the powered piston 112 moved.

As will be discussed further below, the pumping assembly 500 may also include a connector 170 that is connectible to the first end 500A of the pumping assembly 500 for providing fluid communication between the downhole end of the fluid conducting system 606 and the central conduit 508. The connector 170 may also be referred to as a flow distributor. In some embodiments of the present disclosure, the connector 170 may also provide a channel for the conductors of the electrical conducting system 608 to enter inside the pumping assembly 500. In these embodiments, all fluid/conduits that deliver fluids to and from the pumping assembly 500 and all electrical conductors that deliver electrical signals to—and optionally from—the pumping assembly 500 are inside an outer surface 500A of the pumping assembly 500. In some embodiments of the present disclosure, the primary components of the pumping assembly 500, namely: the power assembly 502, the powered actuator assembly 504 and the production fluid assembly 506 are all housed within an outer housing of the pumping assembly 500, and the outer housing defines the outer surface 500C. In other embodiments, each of the power assembly 502, the powered actuator assembly 504 and the production fluid assembly 506 define their own respective outer surface such that when these assemblies are all assembled together into the pumping assembly 500 together they define the outer surface 500C.

Without being bound by any particular theory, the internalization of all fluid conduits, electrical conduits and all other components of the pumping assembly 500 within the outer surface 500C provides a substantially constant external profile of the pumping assembly 500. Furthermore, this internalized design allows the pumping assembly 500 to be constructed with an external diameter that may be smaller than other known submersible, downhole pumping systems. In some embodiments of the present disclosure, the outer diameter of the pumping assembly 500 may be substantially constant along its length from the first end 500A to the second end 500B. In some embodiments of the present disclosure, the external diameter of the pumping assembly 500 may be configured such that the outer surface 500C is substantially free of any protrusions so that that profile of the pumping assembly 500 may be referred to as a "smooth profile".

FIG. 2 provides a non-limiting schematic of function and fluid flows within the pumping assembly 500 during operation thereof.

The power assembly 502 comprises an outer wall 63, which may form part of the outer housing of the pumping assembly 500, or not, but the outer wall 63 contributes towards defining at least part of the outer surface 500C. The outer wall 63 defines an internal plenum 81 that acts a reservoir to hold lower pressure, exhaust fluid 65. The internal plenum 81 also houses a switchable valve 60.

Hydraulic power is provided to the pumping assembly 500 by delivery of the pressurized power fluid 55 from the surface, via conduit 56 and the fluid conducting system 606 to the central conduit 508. The power fluid 55 flows through the length of the pumping assembly 500 to the power assembly 502, where it is directed to a first face 112A or a second face 112B of the powered piston 112. Lower pressure, exhaust fluid 65 return to the internal plenum 81 from where it enters the central conduit 508 for return to the exhaust conduit 66, via the fluid conducting system 606, and to the hydraulic station 300. In summary, the power fluid 55 flows in a closed loop system to and from the surface to the pumping assembly 500 via conduit 56, then through the fluid conducting system 606, then through the central conduit 508 to the valve 60. Movement of the valve 60 between its operational positions, will direct the power fluid to either the first face 112A or the second face 112B of the powered piston 112. Power fluid 65 is directed from the opposite face of the powered piston 112 that the power fluid 55 is acting upon to flow through the valve 60 for return via the central conduit 508 as described above. Being in a closed system, the power fluid 55 may be inside the powered actuator assembly 504 a pressures that are higher than ambient wellbore pressures, which may assist in lubricating and establishing a pressure isolation effect to keep wellbore fluid and contaminants from the moving parts of the powered actuator assembly 504. In some embodiments of the present disclosure, the pressure of the power fluid 55 within the powered actuator assembly 504 may be at least double the ambient wellbore pressures.

As shown in FIG. 2A, the central conduit 508 includes an inner conduit 510 that is coaxial with and extends the length of the central conduit 508. The inner conduit 510 is configured to receive the power fluid 55 from the fluid conducting system 606 and conduct the power fluid 55 to the valve 60. Between the wall of the central conduit 508 and the inner conduit 510 is an annular space that is configured to receive the power fluid 65 from the inner plenum 81 of the power assembly 502 and conduct the power fluid 65 to the conduit 66 via the fluid conducting system 606. As will be appreciated by those skilled in the art, the power fluid 55 is a higher pressure than the power fluid 65, so from a materials and safety perspective, it may be desirable to use the inner conduit 510 conducting the power fluid. However, it is contemplated by the present disclosure, that the inner conduit 501 may be used to conduct the power fluid and the annular space may be used to conduct the power fluid.

The powered actuator assembly 504 may be housed within an outer housing of the pumping assembly 500 or it may include an outer wall 526. In the latter case, the outer wall 526 contributes towards defining the outer surface 500C of the pumping assembly 500. An annular fluid chamber is defined between the outer wall 526 (or the outer housing as the case may be) and a cylinder 528, which in turn houses the powered piston 112. The cylinder 528 has a first end 528A and a second end 528A, the second end 528B proximal to and in fluid communication with the power assembly 502 (see FIG. 2A). The powered piston is configured to slidably move along an inner surface of the cylinder 528 in a first direction towards one end of the cylinder 528 and in a second, opposite direction towards the other end of the cylinder 528. Suitable seals 113 may be positioned between the outer edge of the powered piston 112 and the inner surface of the cylinder 528 to ensure no fluid communication occurs across the powered piston and, optionally, to facilitate the sliding movement of the powered piston 112.

The valve 60 may be an electromechanical switching valve that is configured to receive the power fluid 55 from the central conduit 508 via one or more conduits 56A to direct the flow of the power fluid 55 to either the first face 112A or the second face 112B of the powered piston 112 to cause the piston 112 to move (stroke) in a first direction or a second, opposite direction, or to bypass the powered actuator assembly 504 and merely flow through the valve and complete a circuit back to surface. The three valve positions may be referred to as "direct flow", "cross-over flow" and "bypass" or "idle". The "bypass" valve position isolates the actuator from hydraulic fluid flow and causes the piston 112 to be braked or locked in its then-current position, which is useful to avoid problems when tripping the downhole component into or out of the wellbore where pressure changes will come into play as the pumping assembly 500 is moved uphole or downhole in the well.

Additionally, while in the "bypass" or "idle" position, flow of the hydraulic fluid from surface to the pumping assembly 500 and back becomes relatively unimpeded, permitting fast round-tripping of fresh hydraulic fluid (for example, about 1½ minute per 1,000 feet travel distance) permitting use of the hydraulic fluid as a coolant to cool the pumping assembly, including the valve 60, as desired.

As shown in FIG. 2A, the power fluid 55 is directed by the valve 60 along conduit 56B to enter the powered assembly 504 to act upon the second face 112B of the powered piston 112. Because the powered piston 112 has the first face 112A and the second face 112B and it may move based upon power fluid 55 acting upon either of these faces, the powered piston 112 may be referred to as a dual-acting piston. The powered piston 112 and the cylinder 528 and both of which are configured to accommodate the extension of the central conduit 508 therethrough. When the valve 60 is in the position depicted in FIG. 2A, the power fluid 55 within a first chamber of the cylinder 528 may be present within the cylinder 528 on the second face 112B side of the powered piston 112. As the power fluid 55 acts upon the second face 112B, the exhaust fluid 65 is directed from within the cylinder 528 into the annular fluid space to return to the valve 60 via conduit 66A. From the valve, the power fluid 65 enters the inner plenum 81 for return to the surface as described above. In the configuration of FIG. 2A, the powered piston 112 can be said to be moving in a first direction, in this case an uphole direction.

As shown in FIG. 2B, the power fluid 55 is directed by the valve 60 to enter conduit 56B and move through the annular fluid space to then enter the cylinder 528 to act upon the first face 112A of the powered piston 112. The fluid on the opposite side of the powered piston 112 has lost its pressure, due to the valve 60 opening an exhaust port. As the powered piston 112 moves in the second direction, in this case the downhole direction, the power fluid 65 is directed along conduit 66A to the valve for entry into the inner plenum 81 and return to surface as describe above.

The powered piston 112 is mechanically coupled, or linked, to a production piston 135 that is a component of the production fluid assembly 502. The mechanical coupling may be effected by a sleeve 520 that is fixed at one end to the powered piston 112 and fixed at the other end to the production piston 135. The sleeve 520 can be cylindrical in shape in order to accommodate the central conduit 508 around which the sleeve 520 is positioned. The sleeve 520 may slide along the outer surface of the central conduit 508 or there may be a gap therebetween. In operation, when the powered piston 112 moves in a first direction, for example uphole—due to the position of the valve 60—the production piston 135 will move in the same direction and for the same distance, which may also be referred to as stroke length or stroke distance.

The production fluid assembly 506 includes an outer wall 530, which similar to the power assembly 502 and the powered actuator assembly 504, may form part of an outer housing of the pumping assembly 500 or it may be a discrete structure that together with the outer walls of the power assembly 502 and the powered actuator assembly 504 define the outer surface 500C of the pumping assembly 500.

The production fluid assembly 506 also includes a cylinder 532, within which the production piston 135 slidably moves in two directions. The cylinder 532 has a first end 532A that defines the first end 500A and a second end 532B that is proximal the power actuation assembly 504 (see FIG. 2B). As will be appreciated by those skilled in the art, the production fluid assembly 504 is configured to include various seals in order to perform the functions described herein. The production piston 135 may, similar to the powered piston 112, be a dual-acting piston with a first face 135A and a second face 135B. The cylinder 532 and the piston 135 define two pumping chambers. A first fluid pumping chamber 130 is defined between the first face 135A and the first end 532A and a second fluid pumping chamber 132 is defined between the second face 135B and the second end 532B. As the production fluid piston 125 moves, due to the operative linkage with the powered piston 112, the volume within the two chambers 130, 132 will change, with one increasing and the other decreasing in volume and, thereby having an inverse change in pressure. For example, FIG. 2A depicts the scenario where the valve 60 is directing power fluid 55 into the powered actuator assembly 504 so that the powered piston 112 moves in an uphole direction. Due to the sleeve 520, the production fluid piston 135 also moves in the uphole direction, causing the volume of the first chamber 130 to decrease and the pressure therein to increase. In the second chamber 132, the volume is increasing and the pressure is decreasing as the production fluid piston 135 moves in the uphole direction. The opposite occurs when the valve 60 changes position to direct power fluid 55 into the powered actuator assembly 504, namely the volume of the first chamber 130 increases and the pressure therein decreases and the volume in the second chamber 132 increases and the pressure therein decreases.

The outer wall 530 includes at least two groups of ports 23, 23A and two groups of valves 141, 142 that provide fluid communication between outside of the outer wall 530 of the pumping assembly 500 and inside the cylinder 532. For example, port 23A (see FIG. 2A) may provide fluid communication between outside the pumping assembly 500 and the first face 135A of the production piston 135. Port 23 (see FIG. 2B) may provide fluid communication between outside the pumping assembly 500 and the second face 1358 of the production piston 135. When the pumping assembly 500 is positioned within a well, the pumping assembly 500 will be submerged within various fluids, including production fluids and ports 23, 23A may provide production fluids to be received within either of the chambers 130, 132 of the cylinder 532. Whether or not these fluid communication flow paths are open or closed depend upon the operational position of a valve assembly made up of valves 141, 142, 151 and 152 and the respective pressures within the chambers 130, 132 that each valve controls fluidic access to. Valve 141 controls fluid communication between the second chamber 132 and port 23A for regulating the flow of production fluids through port 23A. Valve 142 controls fluid communication between the second chamber 132 and an annular fluid chamber 529 that is defined between the outer wall 530 and the cylinder 532. Valve 142 is configured for regulating the flow of a pressurized and received production fluid into the annular fluid chamber 529 from where the fluid flows through the first end 500A, through the connector 170 and into the fluid conducting system 606. The annular fluid chamber 529 extends between the first end and the second end of the production fluid assembly 506. Valve 151 controls fluid communication between the annular fluid chamber 529 and the connector 170. Valve 152 controls fluid communication between the first chamber 130 and the connector 170.

FIG. 2A shows two dotted lines A and B, line A indicates a cross-sectional cut through the valve assembly at the first end 532A of the production fluid assembly 506. Line B indicates a cross-sectional cut through the valve assembly at the second end 532B of the assembly 506. Together, lines A and B are taken to represent when the valve 60 is directing power fluid 55 to move the pistons 112 and 135 uphole. FIG. 2B shows two further dotted lines C and D, line C indicates a cross-sectional cut through the valve assembly at the first end 532A and line D indicates a cross-sectional cut through the second end 532B. Together lines B and C are taken to represent when the valve is directing power fluid 55 to move the pistons 112 and 135 downhole.

Figure 3:
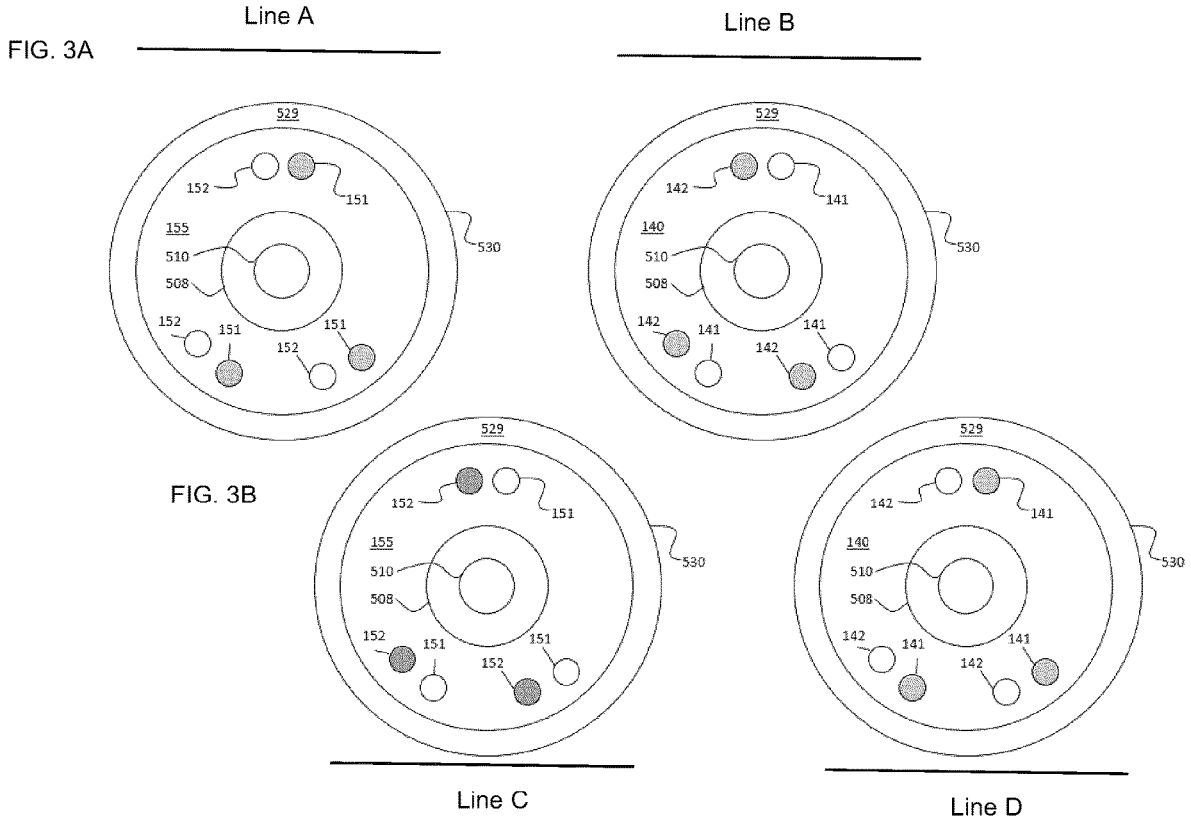

FIG. 3A shows a cross-sectional view of line A and line B. Under line A, the outer surface is shown as the outer wall 530, as described herein above, this represents the outer surface 500C of the pumping assembly 500. Between the outer wall 530 and the outer surface of the cylinder 532 (not shown in this view) is the annular fluid chamber 529. Facing the viewer is a valve seat 155 that may define at least a portion of the first end 532A of the cylinder 532. In the center is the central conduit 508 with the inner conduit 510 therein. While FIG. 3A shows the operational position of three sets of valves 151 and 152 and three sets of valves 141 and 152, there may be more or less of these valves. Under line B, the outer wall 530 and the annular fluid chamber 529 are shown, as is a valve seat 140 that may define at least a portion of the second end 532B of the cylinder 532. In FIG. 3A valves 151 and 142 are shaded to indicate that they are in a closed operational position to prevent fluid communication thereacross. Valves 152 and 141 are shown unshaded to indicate that they are in an open operational position, permitting fluid to flow thereacross. FIG. 3B shows the same structures as FIG. 3A, except valves 152 and 141 are closed and valves 151 and 142 are open. The valves of the valve assembly may be one-way checker valves, such as a floating ball-type valve where the position of the valve (open or closed) is determined by a differential pressure across the valve. For example, the open/closed position of the valves in FIG. 3A is determined by the pressure within the fluid pumping chambers 130, 132, relative to the pressure on the opposite side of each valve.

For example, when the valve 60 causes the pistons 112, 135 to move in the uphole direction (as in FIG. 2A) the pressure within the second chamber 132 is lower than, and may continue to decrease, the ambient pressure of the production fluid that surrounds the pumping assembly 500. This causes valve 141 to open so that production fluids can be received within the chamber 132, via port 23A. At the same time, the pressure within the annular fluid chamber 529 exceeds the pressure within the chamber 132 and this causes the valve 142 to be closed. As the pistons 112, 135 move in the uphole direction, pressure within the first chamber 130 increases and will exceed the pressure of the ambient production fluids, this causes valve 151 to be closed and reservoir fluids are not received within the chamber 130. The pressure within chamber 130 also causes valve 152 to open allowing the received (and pressurized) production fluid therein to flow out of the production fluid assembly 506 and into the connector 170. In effect, FIG. 2A depicts an operational position of the valve assembly whereby production fluids are drawn into the chamber 132 and received production fluids within chamber 130 are pumped out into the connector 170.

FIG. 2B depicts an operational position of the valve assembly, wherein valves 141 and 152 are closed and valves 151 and 142 are open. This operational position directs the received production fluid within chamber 132 to flow through the annular fluid chamber 529 and into the connector 170 and to close off fluid communication between the chamber 132 and outside the production fluid assembly 506. This operational position also allows new production fluids to be received, via port 23, into the chamber 130.

Figure 4:
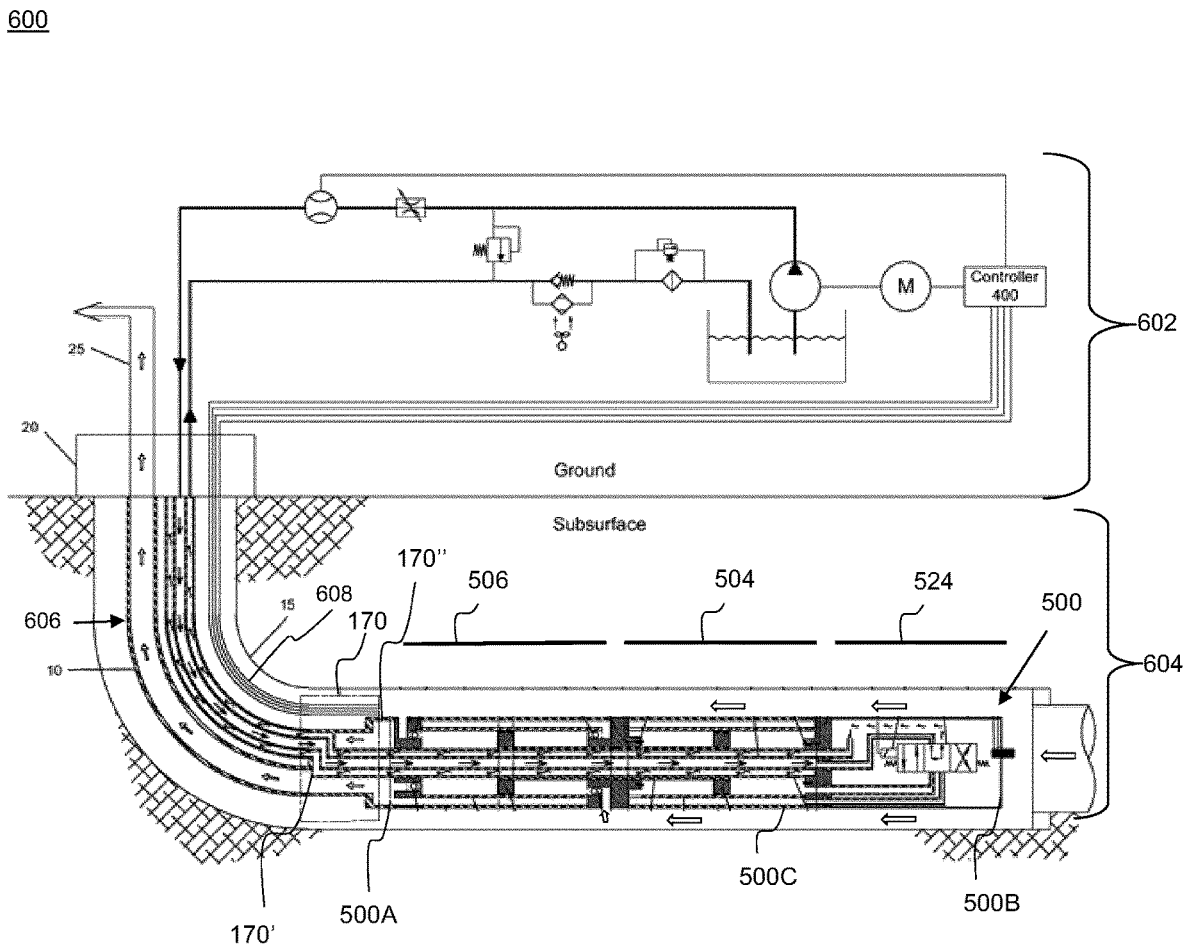
FIG. 4 is a schematic depicting the system of FIG. 1 in greater detail.

FIG. 4 shows the pumping assembly 500 comprising the connector 170 positioned within the wellbore 15 and submerged within production fluids (depicted as open arrows). The operational position of the valve assembly of the production fluid assembly 506 is the same as shown in FIG. 2A and FIG. 3A, so that production fluids may be received within the chamber 132 of the production fluid assembly 506 via port 23A. Connector 170 comprises a first end 170' that is operatively coupled to the downhole end of the fluid conducting system 606 and a second end 170" that is operatively coupled to the first end 500A of the pumping system 500. The connector 170 is configured to provide fluid communication between the downhole end of the fluid conducting system 606 and the central bore a channel for receiving and internalizing the electrical conducting system 608. While the connector 170 is shown in FIG. 4 as having a larger outer diameter than the outer surface 500C of the pumping assembly 500, that is simply to assist with depicting the features and functionality of the connector 170. In fact, the connector 170 has the same or smaller outer diameter than the outer surface 500C. The connector 170 is configured to be operatively coupled to the first end 500A of the pumping assembly 500. In particular, the connector 170 provides one or more internal conduits for conducting pressurized and received production fluids received from the production fluid assembly 506 as described above. The fluid conducting system 606 comprises a production line 10 for conducting the pressurized and received production fluid 25 from the connector 170 up to the wellhead 20. The fluid conducting system 606 further comprises a hydraulic conduction line 610 that provides an extension of the conduits 56 and 66 (see FIG. 6A). In particular, line 610 is configured to house an extension 56A of the conduit 56 positioned within the conduit 66, optionally concentrically positioned within conduit 66 so that the power fluid flows internal to and in an opposite direction as the exhaust fluid 65 through the fluid conducting system 606. The line 610 is configured to fluidly and sealingly connect with a string adapter 171 of the connector 170 to receive and maintain the isolation and flow direction of the power fluid 55 and the exhaust fluid 65 through to an internal fluid channel system 173 of the connector 170 and to conduct same to fluidily communicate with the central conduit 508 (see FIG. 6B). In particular, the power fluid within conduit 56 of line 610 is conducted through the internal fluid channel system 173 of the string adapter 171, through the connector 170 and into the inner conduit 510. The exhaust fluid 66 flows through the annular space of the central conduit 508, through the internal fluid channel system 173 within the connector 170 to enter the extension 65A for conduction to the surface. While FIG. 6B shows the internal fluid channel system 173 as having a corner, the person skilled in the art will appreciate that it may be advantageous to have all corners rounded, smoothed or substantially straightened to reduce, mitigate or remove any negative impact such changes in direction could have on maintaining the pressure of the power fluid 55.

The connector 170 further comprises a production string adapter 172 for fluidly and sealingly connecting the production conduit 10 to the connector 170 to facilitate conducting the pressurized and received production fluid 25 from the production fluid assembly 506.

The connector 170 further comprises an internal channel for conducting the electrical conductors of the electrical conducting system 608 therethrough. This internal channel for electrical conductors is configured to receive the electrical conductors from outside the fluid conducting system 606 and to internalize the electrical conductors so that they may extend from the connector 170, through an internal channel of the pumping assemble 500 to electrically communicate electrical signals from the controller 400 to the valve 60.

Figure 5:
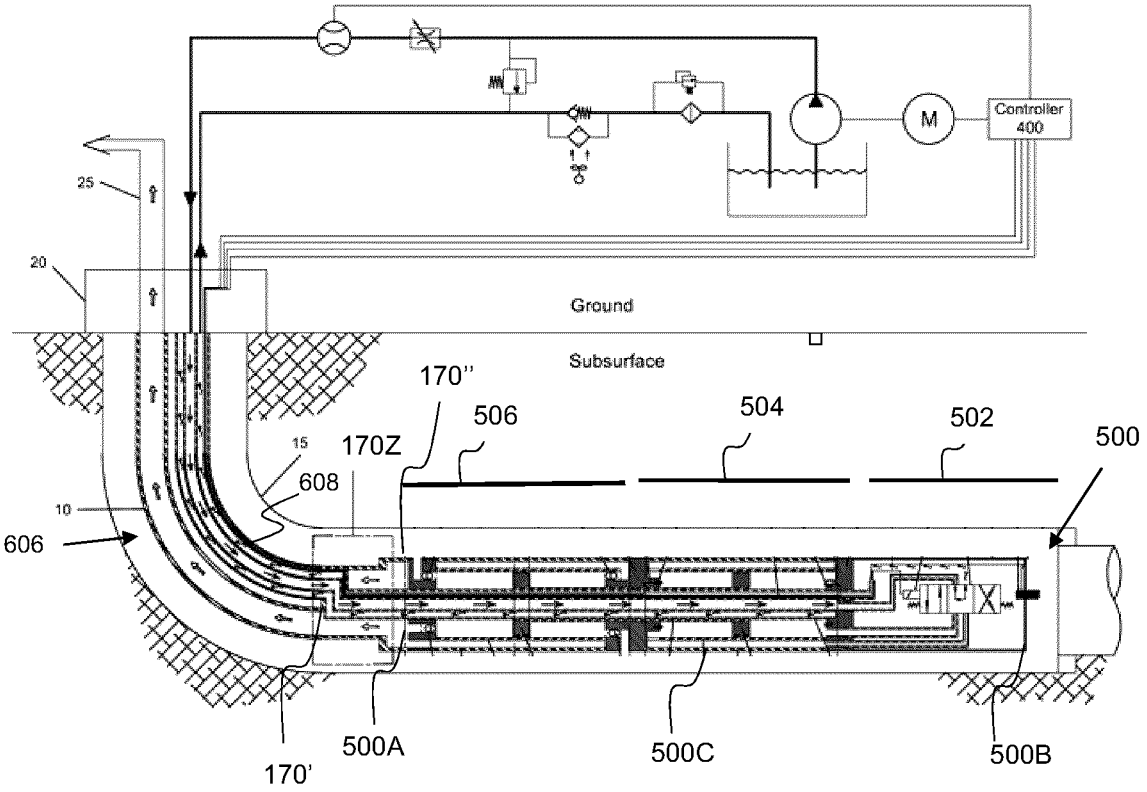
FIG. 5 shows a variation of the system depicted in FIG. 4.

FIG. 5 shows a variation of the connector 170Z all other features described above in relation to FIG. 4 and FIGS. 6A and 6B are the same in FIG. 5 other than the electrical conducting system 608 is conducted down through the wellbore 15 inside the fluid conducting system 606. In particular, the electrical conducting system 606 may be positioned within the extension 66A so that the electrical conductors are within the lower pressure exhaust fluid 65. However, as will be appreciated by the skilled person, electrical conductors that are properly and sufficiently shielded may also be conducted through extension 56A of the fluid conducting system 606. The electrical conducting system 608 allows electrical signals generated at the controller 400 to be transmitted downhole to change the operational position of valve 60, as is known and generally understood in the art. The connector 170Z is configured to internalize the electrical conductors of the electrical conduction system 608, as described above regarding connector 170. FIG. 6A depicts how the above-ground system 602 may be configured in order to receive and deliver the correct fluid into the correct conduit of the fluid conducting system 606.

Figure 7:
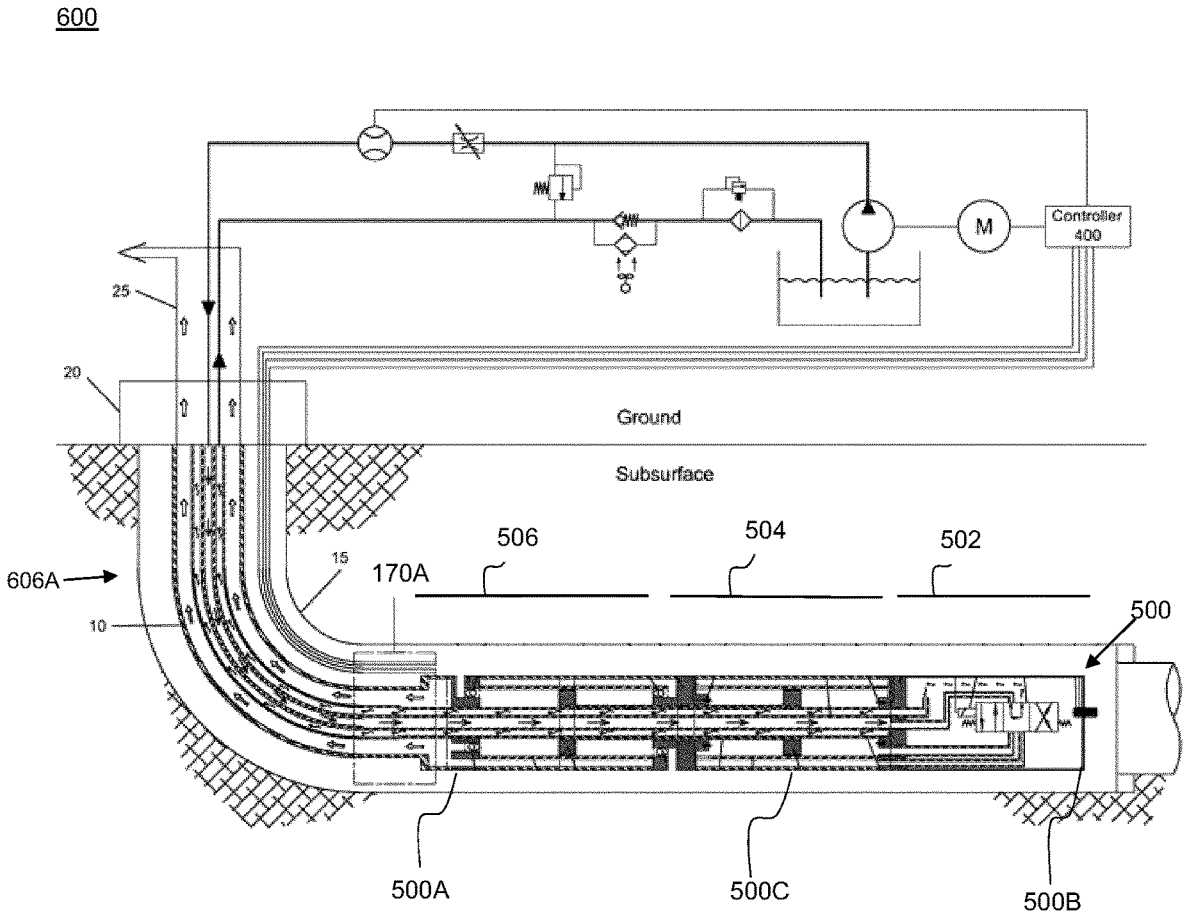
FIG. 7 shows a variation of the system depicted in FIG. 4.

FIG. 7 shows another variation of the system 600, where a fluid conducting system 606A comprises a three extension fluid conduits with a first conduit (inner conduit) nested within a second conduit (middle conduit) and the second conduit nested within a third conduit (outer conduit). In some embodiments the first, second and third conduits may be arranged coaxially and, optionally concentrically, with each other. Collectively, the three extension fluid conduits may be referred to as a triple conduit. As shown in FIG. 8A, the inner conduit may be extension 55 A, which is positioned within extension 65A, which is positioned within an extension 10A of the production line 10. FIG. 8A depicts how the above-ground system 602 may be configured in order to receive and deliver the correct fluid into the correct conduit of the fluid conducting system 606A.

FIG. 8B shows a closer view of another variation of a connector 170A for use with fluid conducting system 606A. The connector 170A may be configured to provide fluid communication therethrough for conducting the pressurized and received production fluids from the production fluid assembly 506, the exhaust fluid from the central conduit 508 and the power fluid 55 to the inner conduit 510. The connector 170A is also configured to internalize the electrical conductors of the electrical conducting system 608, as described herein above, or not. The connector 170A comprises a low pressure latch 171B for fluidly coupling with the extension 66A, a high pressure latch 172B for fluidly coupling with the extension 56A and a production coupler 173B, such as a production mandrel to fluidly couple with the extension 10A.

As will be appreciated by those skilled in the art, the electrical conductors of system 608 may be enclosed within one or more conduits of the fluid conducting system 606A or not.

Figure 9:
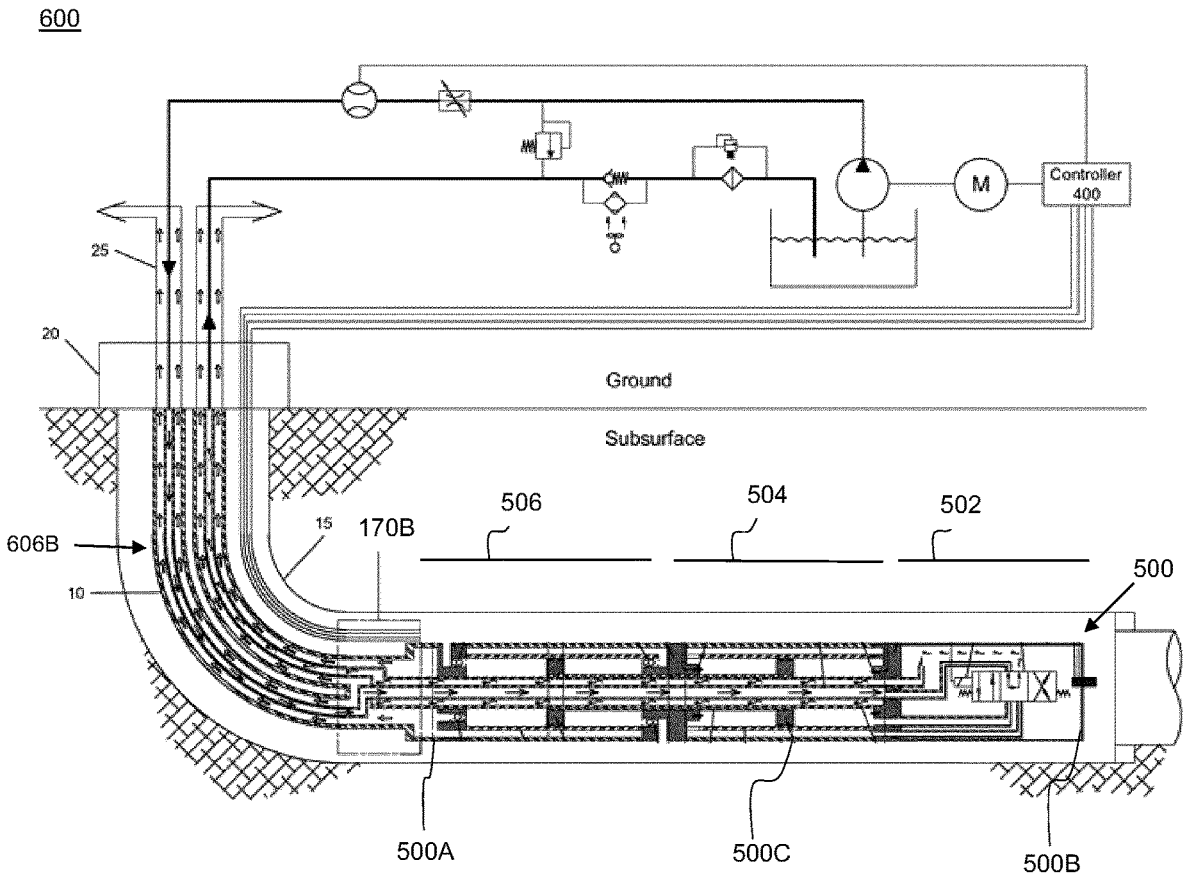
FIG. 9 shows a variation of the system depicted in FIG. 4.

FIG. 9 shows another variation of the system 600, where a fluid conducting system 606B comprises two sets of two nested fluid conduits. As shown in FIG. 10A each set of the two nested fluid conduits includes an inner conduit and an outer conduit. One set of the nested conduits 606B' may comprise the extension 10A as the outer conduit and the extension 66A as the inner conduit. The other set of the nested conduits 606B" may comprise the extension 56A as the inner conduit and a second extension 10A as the outer conduit. FIG. 10A depicts how the above-ground system 602 may be configured in order to receive and deliver the correct fluid into the correct conduit of the fluid conducting system 606B.

As will be appreciated by those skilled in the art, the electrical conductors of system 608 may be enclosed within one or more conduits of the fluid conducting system 606B or not.

FIG. 10B shows a closer view of another variation of a connector 170B for use with fluid conducting system 606B. The connector 170B may be configured to provide fluid communication therethrough for conducting the exhaust fluid from the central conduit 508 and the power fluid 55 to the inner conduit 510. The connector 170B is also configured to internalize the electrical conductors of the electrical conducting system 608, as described herein above, or not. The connector 170B may comprise a scoop head 171C for fluidly and sealingly engaging the outer surface of each set of the two nested fluid conduits, a low pressure latch 1728 that is configured to fluidly connect with, anchor and seal with the extension 66A and a high pressure latch 1738 that is configured to fluidly connect, anchor and seal with the extension 56A and a concentric string adapter 1748 that is configured to connect the outer surface of extension 10A with the scoop head 171C.

Figure 11:
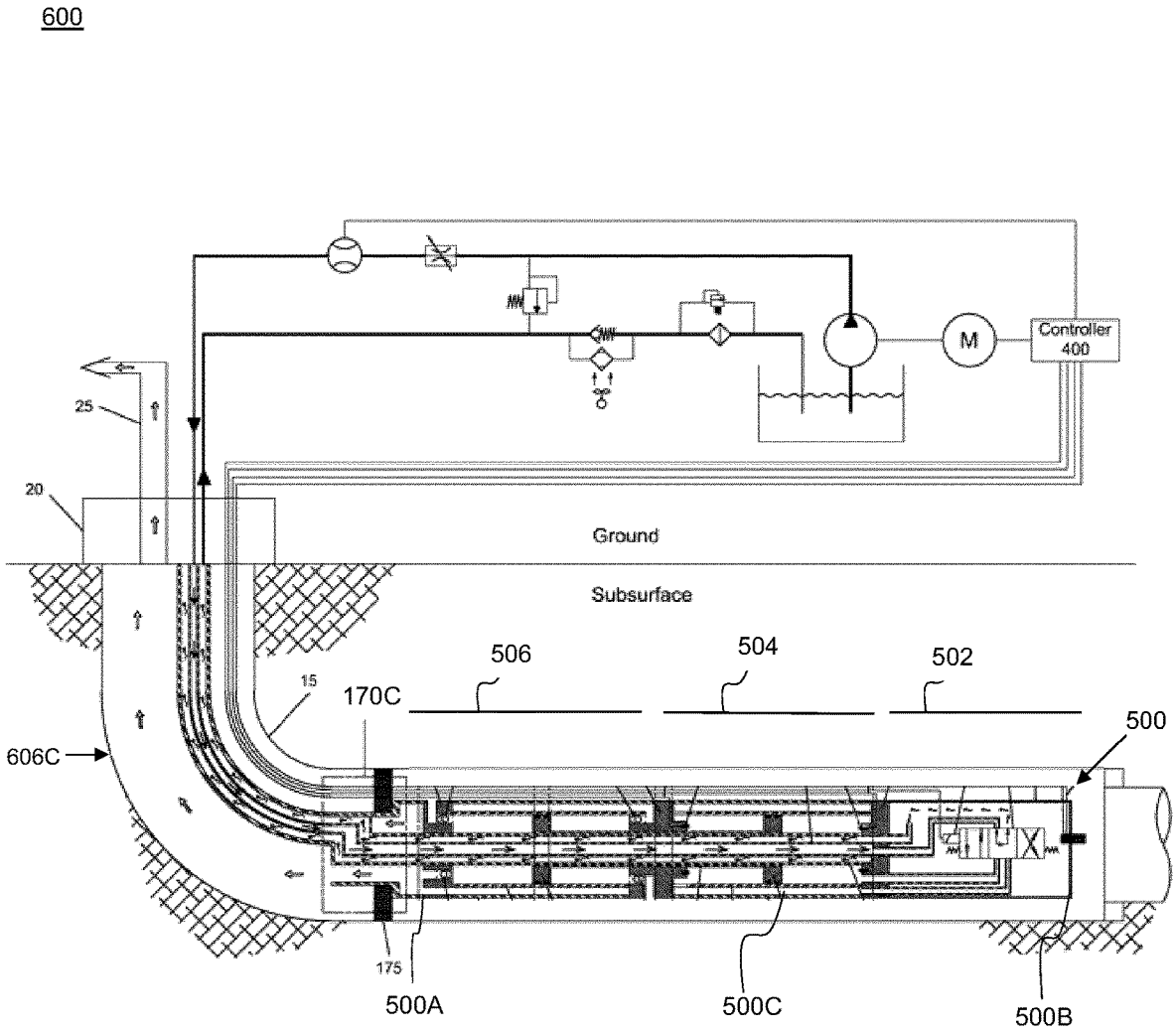
FIG. 11 shows a variation of the system depicted in FIG. 4.
Figure 12:
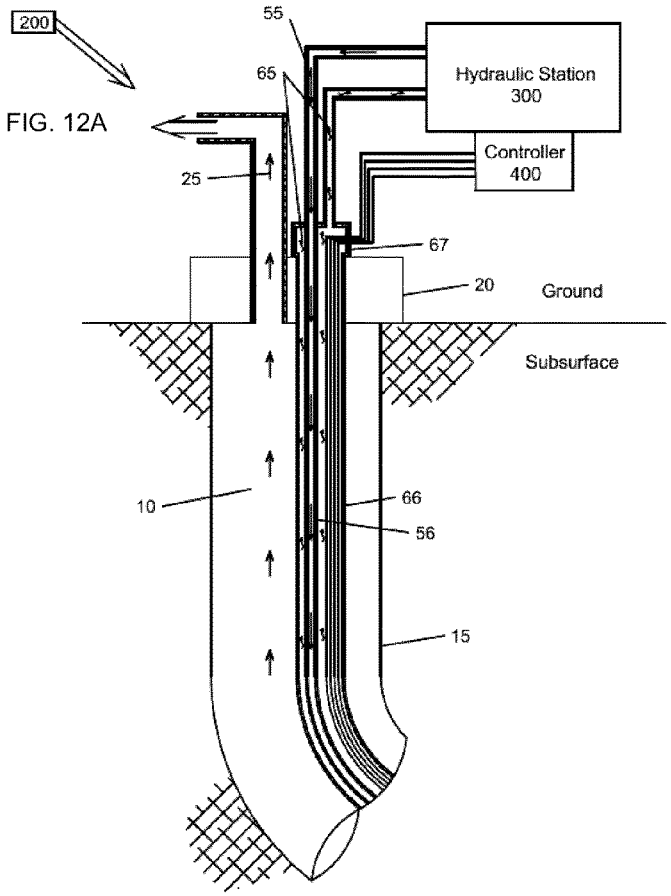
Figure 12:
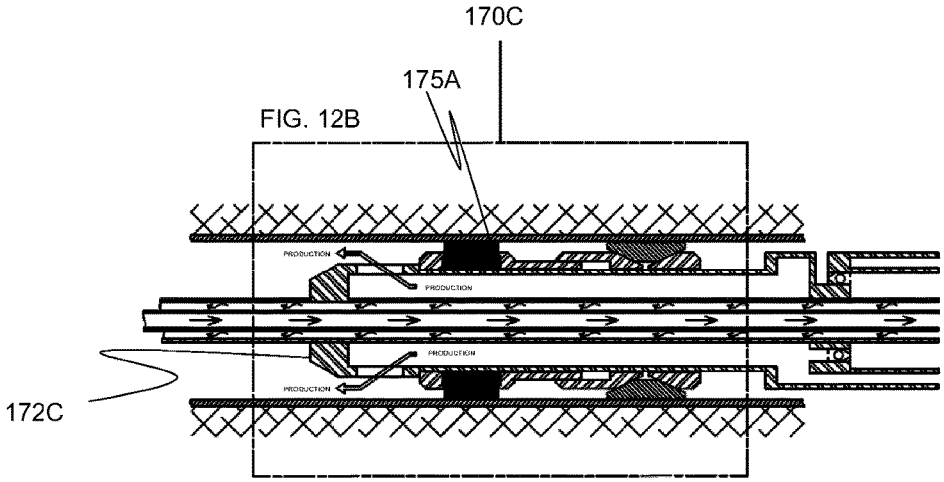

FIG. 11 shows another variation of the system 600, where a fluid conducting system 606C comprises one set nested fluid conduits. As shown in FIG. 12A each set of the two nested fluid conduits includes an inner conduit and an outer conduit. Within the set of nested conduits the extension 66A may be the outer conduit and the extension 56A may be the inner conduit. FIGS. 11 and 12 both further show that the wellbore 15 may act as the conduit for directing the pressurized and received production fluid 25 to the wellbore 20. FIG. 12A depicts how the above-ground system 602 may be configured in order to receive and deliver the correct fluid into the correct conduit of the fluid conducting system 606C.

FIG. 12B shows a closer view of another variation of a connector 170C for use with the fluid conducting system 606C that is configured to provide fluid communication therethrough for conducting the exhaust fluid from the central conduit 508 and the power fluid 55 to the inner conduit 510. The connector 170B is also configured to internalize the electrical conductors of the electrical conducting system 608, as described herein above, or not. The connector 170C further comprises one or more of a packing assembly that are each configured to be connected to an outer surface of the connector 170C and for establishing a fluid seal against the inner wall of the conduit 15. The packing assembly 175 may comprise one or more packing elements 175A and one or more anchor elements 175B, as is understood in the art, and a concentric string adapter for fluidly connecting the extension 55 A and extension 66A with the internal fluid channel of the connector 170C so that when the pressurized and received production fluid passes through the connector 170C, it will move uphole through the wellbore 15 to the wellhead 20.

As will be appreciated by those skilled in the art, the electrical conductors of system 608 may be enclosed within one or more conduits of the fluid conducting system 606C or not.

Figure 13:
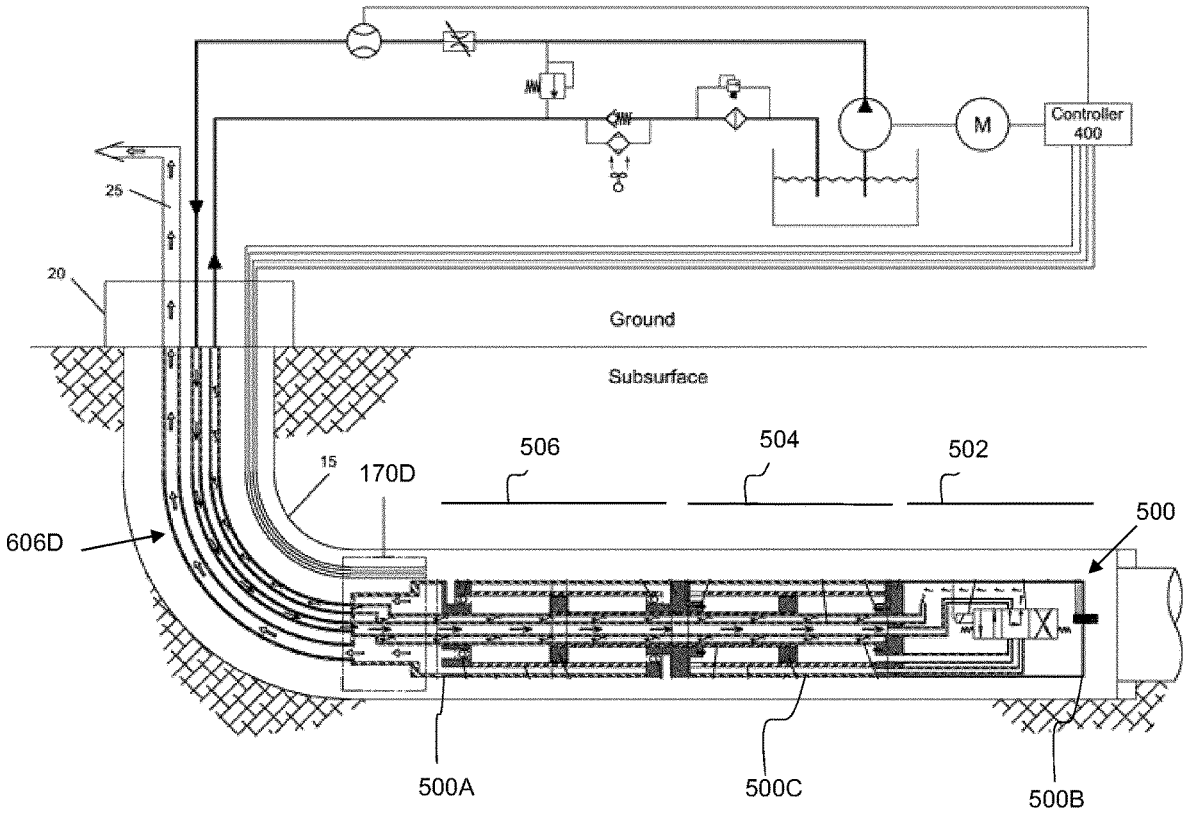
FIG. 13 shows a variation of the system depicted in FIG. 4.

FIG. 13 shows another variation of the system 600, where a fluid conducting system 606D comprises three separate fluid conduits. As shown in FIG. 14A the extension 55 A may be one of the separate fluid conduits, the extension 66A may be one of the separate fluid conduits and the extension 10A may be one of the separate fluid conduits. and the extension 56A may be the inner conduit. FIGS. 11 and 12 both further show that the wellbore 15 may act as the conduit for directing the pressurized and received production fluid 25 to the wellbore 20. FIG. 14A depicts how the above-ground system 602 may be configured in order to receive and deliver the correct fluid into the correct conduit of the fluid conducting system 606D.

FIG. 14B shows a closer view of another variation of a connector 170D for use with the fluid conducting system 606D that is configured to provide fluid communication therethrough for conducting the exhaust fluid 65 from the central conduit 508 and the power fluid 55 to the inner conduit 510. The connector 170D is also configured to internalize the electrical conductors of the electrical conducting system 608, as described herein above, or not. The connector 170D may comprise a high pressure string adapter 171D for fluidly connecting the extension 56A with the appropriate internal fluid channel of the connector 170D, a low pressure string adapter 172D for fluid connecting the extension 66A with the appropriate internal fluid channel of the connector 170D and a production string adapter for fluidly connecting the extension 10A with the appropriate internal fluid channel of the connector 170D.

Without being bound to any particular theory, because the valve 60 is located at the downhole end of the pumping assembly 500 within of the wellbore 15, the fluid in the hydraulic power conduits 56, 56A always flows downward to the pumping assembly 500 and the exhaust fluid in the conduits 65, 65A always flows upward. The flow direction of these fluids does not reverse, so that momentum effects on the thousands of feet of included fluid are negligible. This avoids issues that can arise in systems where hydraulic fluid flow direction is switched at the surface, when flow is stopped or its direction changed by valves at surface, the conduit which was just carrying a column of hydraulic fluid the length of the distance between the surface switching valve and a hydraulic actuator piston will undergo stresses resulting first from a stoppage of fluid flow, resulting in a drop in internal conduit pressure above the associated actuator. This may cause a surge in internal conduit pressure in the other conduit above the associated actuator as pressure from above collides with continued up-flow of hydraulic fluid in that conduit which was just previously under pump pressure upward. These stresses are akin to a 'water hammer' effect, and cause inordinate and unnecessary stress and strain on conduit, connectors, seals, splices and other fluid conducting equipment. In those hydraulic systems, the hydraulic power coming from the surface source would mostly be wasted on reciprocating the thousands of feet long column of fast flowing pressure oil, and little power would be left for the oil column to power the actuator at the bottom end of the column. This system 600 of the present disclosure may address this issue by placing the valve 60 at the downhole location and the power assembly 504 does not change the flow direction of the power fluid 55 or the exhaust fluid 65, may reduce or substantially eliminate the "water hammer" effect.

The stroke length of the pistons will depend upon the desired length of the rigid pumping assembly 500 that the wellbore's 15 deviation can accommodate. The pistons 112 and 135 disclosed herein can have any length of stroke, but the preferred range of stroke length is around 10 feet (more or less) which is similar to common or conventional sucker-rod pump equipment—this permits compatibility where required with conventional hardware and methods.

For clarity, it should be noted that the valve 60 may in fact be accomplished by a series of valves, one that cycles between close (idle or bypass) and open (to permit flow to a next valve) and a next valve in line which cycles between straight-through and cross-over hydraulic circuits. In this case, the bypass valve may be controlled from surface while the straight/cross-over valve may be controlled locally (at the power assembly 502). A variety of possible control circuits and valve arrangements are possible. In some embodiments, there may be a switch valve (directional switch valve between straight and cross-over circuits) and two limit switches (for max stroke, one switch at or near the end of a stroke, assembled such that there is a limit switch at a location where a piston of the system will be near an end of its linear movement in one direction and another limit switch at the end of the linear movement of a piston—not necessarily the same piston—in the opposite direction of its stroke). These limit switches may be wired to surface by electrical signal conduits electrically connected to the controller 400, which can direct the switching valve downhole to either a straight-through or a cross-over position (and if equipped, to a bypass position). The control signal can be provided, depending upon the configuration of the electrical control circuits and the controller functions, from either or both of the downhole limit switches, or from surface controller systems, and can be automatic or done by manual operation. A variety of stroke lengths may be made available through feedback to the controller 400 to and from surface flow sensing and control devices, which may direct the switch to change hydraulic flow circuit directions in the actuator or otherwise control hydraulic fluid flow rates and power from surface. In order to integrate all those complicated controller functions, the PLC 402 at surface equipment will play a central role, where all system devices, including the valve 60 and all temperature devices and pressure devices located everywhere in the whole system, will be centrally controlled and displayed by PLC 402.

As will be appreciated by those skilled in the art, the present disclosure contemplates further modifications of the above described embodiments and variation of the system 600. For example, nested conduits may be concentrically arranged, or not; electrical conductors may extend from surface to the pumping assembly 500 inside a conduit of the fluid conducting system, or not. The contents and flow direction of any given conduit described herein may be exchanged with another content and flow direction, provided the circuit of power fluid and exhaust fluid is maintained and that the pressurized and retained production fluid is directed to the wellhead for handling. The outer surface of the pumping assembly 500 may be defined by a separate housing or it may be defined by an outer wall of the power assembly 502, an outer wall of the powered actuator assembly 506 and an outer wall of the production fluid assembly 506. Where the pumping assembly 500 does not include such a housing, the outer surface 500C has a substantially constant outer diameter that is substantially free of any protruding members extending outwardly and/or radially therefrom. Each of the assemblies 502, 504 and 506 are operatively coupled together according to mechanisms known in the art, provided that such mechanisms do not interfere with the central conduit 508 extending from the first end 500A to the uphole end of the power assembly 502.

The invention claimed is:

1. A downhole pumping assembly, the assembly comprising:

a. a first end and a second end defining an outer surface therebetween, the outer surface having a substantially constant outer diameter;

b. a power assembly proximal the second end and configured to direct a power fluid;

c. a production fluid assembly proximal the first end and configured to receive wellbore fluids and comprising a production piston configured to direct the received wellbore fluids towards the first end;

d. a powered actuation assembly positioned adjacent the power assembly and in fluid communication therewith, the powered actuation assembly is operatively coupled to the production fluid assembly, the powered actuation assembly configured to receive the power fluid and to move the production piston via the operative coupling for directing the received wellbore fluids towards the first end;

e. a central conduit that extends from the first end to the powered actuation assembly for conducting the power fluid therebetween; and f. an inner conduit positioned within the central conduit, wherein the inner conduit is configured to conduct a first fluid and wherein an annular fluid passage is defined between the central conduit and the inner conduit, wherein the annular fluid passage is configured to conduct a second fluid; wherein the first fluid is at a first pressure and the second fluid is at a second pressure and the first pressure is different from the second pressure, wherein the first fluid is the power fluid and the second fluid is an exhaust fluid or wherein the first fluid is an exhaust fluid and the second fluid is the power fluid.

2. The pumping assembly of claim 1, wherein the inner conduit is configured to conduct the first fluid from the first end to the power assembly and the annular fluid passage is configured to conduct the second fluid from the power assembly to the first end.

3. The pumping assembly of claim 1, further comprising a conducting assembly for conducting electrical signals from the first end to the power assembly, wherein the conducting assembly is interior to the outer surface.

4. The pumping assembly of claim 3, wherein the power assembly comprises a switchable valve under control of the electrical signals for directing the power fluid to a first face or a second face of a powered piston of the powered actuation assembly, wherein when the power fluid is directed to the first face, the powered piston and the production piston both move in a first direction to direct the received production fluids towards the first end.

5. The pumping assembly of claim 4, wherein when the switchable valve directs the power fluid to the second face the powered piston and the production piston move in a second direction to direct the received production fluids towards the first end by an annular production fluid chamber defined by the production fluid assembly.

6. The pumping assembly of claim 4, wherein the production fluid assembly further comprises a valve assembly that is configured to control fluid communication between outside the outer surface and a first face of the production piston.

7. The pumping assembly of claim 6, wherein the valve assembly is further configured to control fluid communication of the received production fluids between the first face of the production piston and the first end.

8. The pumping assembly of claim 4, wherein the production fluid assembly further comprises a second valve assembly that is configured to control fluid communication between outside the outer surface and a second face of the production piston.

9. The pumping assembly of claim 8, wherein the second valve assembly is further configured to control fluid communication of received production fluids between the second face of the production piston and the annular chamber.

10. The pumping assembly of claim 1, further comprising a connector that is coupled to the first end, the connector is configured to provide fluid communication between a fluid conducting system and the central conduit.

* * * * *